US005390825A

United States Patent [19]

Rockel

[11] Patent Number: 5,390,825

[45] Date of Patent: Feb. 21, 1995

[54] PORTABLE, SELF CONTAINED, TWO-PART ADHESIVE DISPENSING DEVICE

[76] Inventor: Christopher M. Rockel, 1929 Greenpoint Apt. 302, Kirkwood, Mo. 63122

[21] Appl. No.: 29,126

[22] Filed: Mar. 10, 1993

[51] Int. Cl.[6] ..... B67D 5/52

[52] U.S. Cl. ..... 222/135; 222/145; 222/326; 222/165; 222/608

[58] Field of Search ..... 222/135-137, 222/145, 325-327, 164, 165, 608

[56] References Cited

U.S. PATENT DOCUMENTS

| | | | |
|---|---|---|---|
| 4,067,479 | 1/1978 | Moline . | |
| 4,212,413 | 7/1980 | Barber, Jr. et al. . | |
| 4,314,653 | 2/1982 | Sindoni | 222/137 X |
| 4,334,636 | 6/1982 | Paul . | |
| 4,366,918 | 1/1983 | Naka . | |
| 4,378,075 | 3/1983 | Voss et al. . | |
| 4,676,410 | 6/1987 | von Flue | 222/137 X |
| 4,693,397 | 9/1987 | Lang . | |
| 4,753,536 | 6/1988 | Spehar et al. . | |
| 4,830,230 | 5/1989 | Powers . | |
| 4,871,088 | 10/1989 | Cox | 222/137 X |
| 4,911,328 | 3/1990 | Keller | 222/137 X |
| 4,986,443 | 1/1991 | Saur et al. . | |
| 5,020,693 | 6/1991 | Ernst et al. . | |
| 5,224,629 | 7/1993 | Hsich | 222/137 X |

FOREIGN PATENT DOCUMENTS

| | | | |
|---|---|---|---|
| 4032349 | 4/1991 | Germany | 222/137 |

*Primary Examiner*—Andres Kashnikow
*Assistant Examiner*—Kenneth DeRosa
*Attorney, Agent, or Firm*—Polster, Lieder, Woodruff & Lucchesi

[57] ABSTRACT

A self-contained device for dispensing two-part adhesive comprising a cart, first and second cartridge holders on the cart, each holder having an adhesive dispensing outlet and a seal-piercing die at the lower end, and an opening at the upper end for receiving a pre-filled adhesive cartridge sealed at its discharge end. A plunger assembly having first and second plunger is mounted at the cartridge receiving openings of the cartridge holders. The plungers are operatively connected to a hydraulic cylinder so that the plungers and hydraulic cylinder move in unison. The plunger assembly is pivotable from locked to unlocked position to permit loading and unloading of pre-filled cartridges. Each plunger has an expandable plunger cup which engages the adhesive component in the associated cartridge as the plunger moves downwardly in the cartridge, thereby forcing the adhesive and seal against the die to rupture the seal and discharge the adhesive component through the dispensing outlet. The hydraulic cylinder is operatively connected to a hydraulic pump which is powered by a self-contained power source.

17 Claims, 5 Drawing Sheets

PORTABLE, SELF CONTAINED, TWO-PART ADHESIVE DISPENSING DEVICE

BACKGROUND OF THE INVENTION

This invention relates to a device for the dispensing or delivery of adhesive materials, more particularly, to a self-contained, portable device for the controlled, 1:1 ratio dispensing of a two-part epoxy adhesive from pre-filled cartridges and to the method of using the same.

Two-part adhesives are generally comprised of a resin component and a catalyst or hardener component. The two components are kept in separate containers and mixed together just before application. Often the resin and the catalyst are mixed in a 1:1 ratio. Two-part adhesives, such as two-part epoxy adhesives, are widely used in construction projects for various applications such as setting studs or anchors in preformed holes in concrete or masonary, or used as a joint filler in highway construction projects.

Generally, for use on construction projects, large doses of such adhesives are required. One application may consume the entire contents of many small, hand held cartridges. For larger applications, buckets of the separate adhesive components are poured into reservoirs on the dispenser and pumped out to the work surface. It is, therefore, an advantage to have a dispensing apparatus that can hold and dispense a large quantity of the two-part adhesive. For example, it is advantageous to have a dispensing machine that can hold and deliver up to 2½ gallons or more of a two-part adhesive between refills so that work on a project can continue in an uninterrupted manner.

Commercial dispensing or pumping devices are known to the art. However, these prior art devices have significant drawbacks. For example, many prior art dispensers are designed as small, hand held devices which use small volume, pre-filled cartridges. As stated above, many such cartridges are required for one job. This is not cost effective, and, requires work stoppage during reloading of the dispensing devices.

Secondly, many of the large volume dispensing devices are not self-contained. They are designed for stationary use or require an external power source. For example, many of the larger devices are powered by compressed air and require a separate air compressor at the construction site. Providing a separate power source increases capital outlay and overhead costs. Moreover, air pressure pumps can be unreliable in response to changes in ambiant temperature. As the ambiant temperature of the adhesive drops, the adhesive materials get thicker and move slower at any given air pressure setting. This requires that the air pressure setting be constantly adjusted depending upon fluctuations in ambiant temperature. U.S. Pat. No. 5,020,693 to Ernst et al. and U.S. Pat. No. 4,067,479 to Moline disclose such devices requiring a separate air source.

Another disadvantage of the prior art large volume adhesive dispensing devices is that they utilize two reservoirs or hoppers to hold the resin and catalyst. Such devices are disclosed in U.S. Pat. No. 4,366,918 to Naka and U.S. Pat. No. 4,693,397 to Lang. Bulk containers or buckets of the resin and catalyst are dumped into each of the reservoirs. Due to the viscosity of the material, a substantial amount of adhesive material is retained in the bulk container and is wasted. As much as twenty percent (20%) of the bulk container may be wasted because it cannot be removed from the bucket. Additional adhesive is retained in the reservoirs and is discarded. This represents considerable waste of a product having a wholesale cost that can run in excess of $30 per gallon.

Attempts to remedy the aforestated deficiencies have included the use of pre-filled cartridges. As stated above, heretofore, the cartridges have necessarily been small, requiring the use of multiple cartridges for each application. On an economy of scale, this is a costly way to provide a epoxy for construction applications. Furthermore, there are other problems associated with small cartridges and the dispensing devices.

These dispensers usually are guns generally employing a plunger to force the material out of the cartridge. The more pressure applied to the cartridge, the greater the chance that the plunger will cause stretching of the cartridge which results in leakage of material between the cartridge and the plunger. Furthermore, the constant pressure applied to the contents of the cartridge by ratcheting or by a threaded screw-drive plunger forces the material out of the cartridge, resulting in unwanted dribbling or leaking out of the dispensing nozzle. Examples of such devices are disclosed in U.S. Pat. Nos. 4,758,536 to Spehar et al. and 4,986,443 to Saur et al.

Another type of adhesive dispenser is a pump employing a pair of double-action reciprocating pumps, one for the resin and one for the catalyst, which move product on both sides of the piston to a mixing head and out of a static mixer. Since the adhesive is drawn into one side of the pump and forced out of the other side, an obvious drawback to this design is the excessive wear and deterioration of the moving parts. Low-cost adhesive compounds have abrasives dispersed throughout. These abrasives can cause wear and damage to the reciprocating pump interior walls and piston as the material is drawn through the pump. As the pump wears it looses efficiency and fails to deliver appropriate quantities of each separate ingredient. For example, the quantities of product pumped through each pump may vary and thereby disrupt the required ratio of resin to catalyst.

It is, therefore, a principal object of the present invention to provide a self-contained, portable two-part adhesive dispenser capable of dispensing large volumes of adhesive material from large volume pre-filled cartridges.

It is another object of the present invention to provide a portable, two-part adhesive dispenser wherein pre-filled cartridges are inserted into a pair of cylindrical openings in a cartridge housing to prevent stretching of the cartridges and leakage under pressure during dispensing.

Another object of the invention is to provide a self-contained, portable two-part adhesive dispenser in which adhesive material is forced out of the pre-filled cartridges by a pair of plungers moving in unison with a hydraulic piston.

Yet another object of the invention is to provide a self-contained, portable two-part adhesive dispenser wherein a hydraulic dispensing piston is driven by pump powered by a a self-contained power source such as a small horsepower gasoline engine.

Still another object of the invention is to provide a self-contained, portable two-part adhesive dispenser in which expandable, flexible sealing plunger cups contact the adhesive material directly to force the adhesive material out of the cartridge and prevent escape of the adhesive behind the cups.

Another object of the invention is to provide a self-contained, portable two-part adhesive dispenser having no moving metal parts that come in contact with abrasives in the adhesive material.

Still another object of the invention is to provide a self-contained, portable two-part adhesive dispenser in which a hydraulic piston and dual plunger assembly is pivotable out of the way of a cartridge housing having cylindrical openings therein to provide access to the openings so that pre-filled cartridges can be loaded into and empty cartridges removed from the housing.

A further object is to provide a dispensing device which uses pre-filled cartridges, which cartridges have a central dispensing opening sealed with a severable cover in one end and a series of concentric grooves surrounding the opening, said grooves being aligned with seals on the dispensing device to prevent leakage when product is dispensed from the cartridges.

Still another object of the present invention is to provide a self-contained, portable two-part adhesive dispensing device in which the plungers can force all of the material out of pre-filled adhesive cartridges thereby avoiding waste.

Yet another object of the invention is to provide a self-contained, portable two-part adhesive dispenser having a minimum of moving parts, is simple and economical to manufacture and assemble, easy to transport and well suited for its intended purpose.

These and other objectives and advantages will become apparent hereinafter.

SUMMARY OF THE INVENTION

The present invention concerns a self-contained, portable device for the delivery of a two-part adhesive which comprises a support structure, a cartridge receiving assembly having a first member containing a pair of receptacles for holding adhesive filled cartridges, and a second member movable from a locked dispensing position to an open loading position whereby cartridges of adhesive components can be loaded and unloaded into the receptacles, an ejection mechanism movable in unison into the cartridges at one end to force the adhesive components out the other ends into a mixing chamber, and means for applying the mixed adhesive to a desired location.

DESCRIPTION OF THE PREFERRED EMBODIMENT

Figure 1:
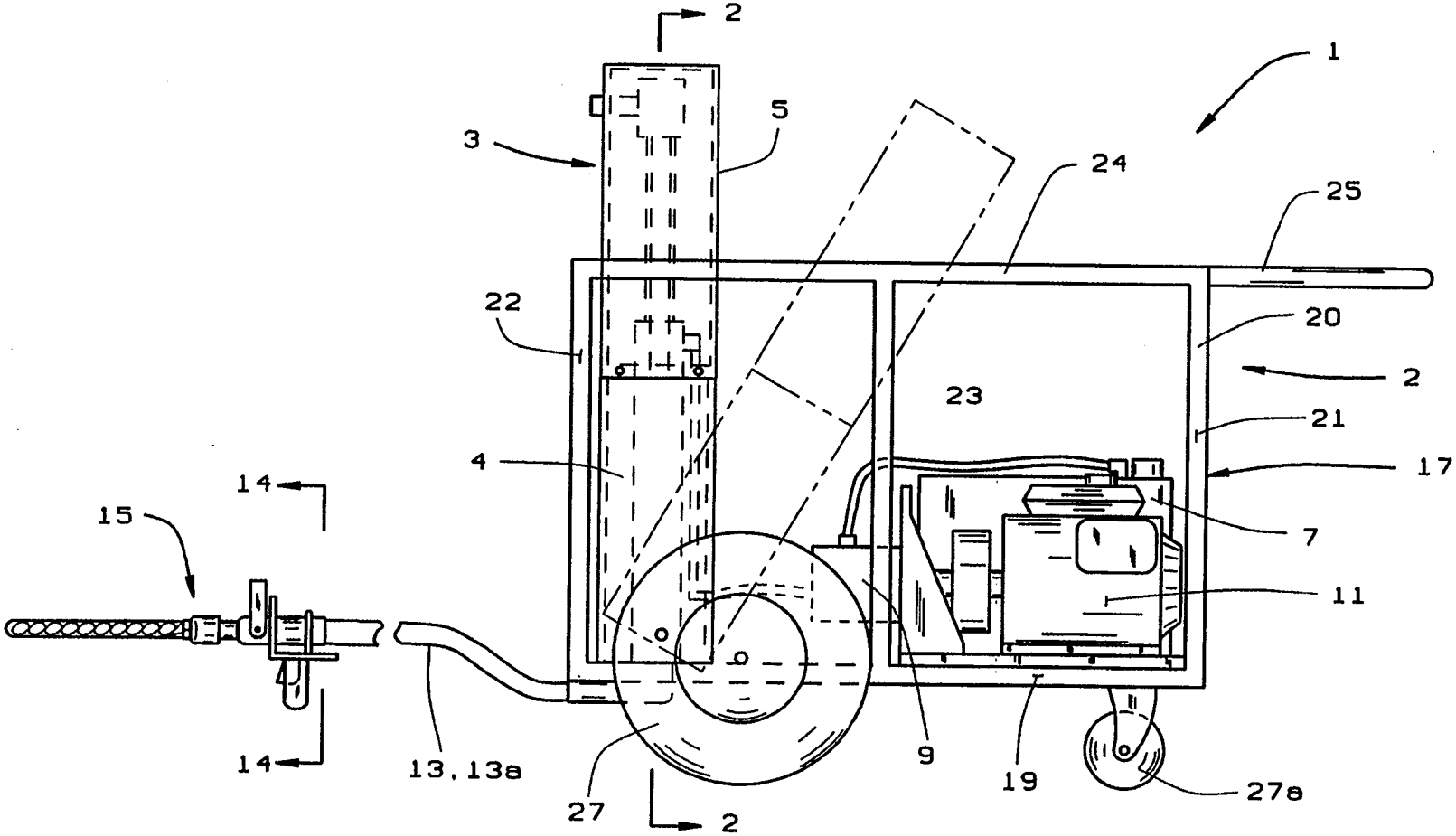
FIG. 1 is a detailed side elevational view of the self-contained, portable two-part adhesive dispensing unit of the present invention showing the dispensing mechanism pivoted to loading and unloading position in broken lines.

Referring now to the drawings, a portable, self-contained two part adhesive dispensing device of the present invention is shown generally by reference numeral 1 in FIG. 1. The dispensing device 1 includes a support structure 2 on which is mounted a two member pre-filled cartridge housing and dispensing assembly shown generally at 3. The assembly 3 includes a first cartridge receiving member 4 and a second member 5 which is a pivotable hydraulic-actuated dispensing assembly. The hydraulic-actuated dispensing assembly 5 is driven by hydraulic fluid from a hydraulic fluid reservoir 7 under pressure of a hydraulic pump 9 which is powered by a self-contained power source 11, shown in the preferred embodiment as a 5.5 horsepower gasoline engine having a 6:1 gear reduction. It should be noted that although alternative power sources may be used without departing from the scope of the invention, the 5.5 horsepower engine provides adequate power to the pump while the 6:1 gear reduction provides a power step-down that allows cooler operation of the hydraulic system for longer periods of time.

The cartridge holder assembly 4 is operatively connected to discharge hoses 13, **13*a*** which cooperate with an adhesive mixing and dispensing nozzle assembly shown generally at 15.

The aforesaid components of the dispenser assembly 1 are mounted on the support structure 2 which, in the preferred embodiment, is a wheeled cart 17 having a floor 19 and an upper box-like frame 20. The frame 20 is formed of tubular steel or other suitable material, and contains two pairs of opposed end columns 21 and 22, a pair of opposed central columns 23, and a pair of opposed horizontal trusses 24 which connect the tops of the columns 21, 22, 23. A U-shaped handle 25 extends outwardly from one end of each of the trusses 24. A first set of wheels 27 are located under the dispenser and cartridge holder assembly 3, and a smaller set of balancing wheels **27*a* are situated at the opposite end proximate the handles 25**.

It should be noted that the support structure 2 can be constructed in any useful configuration and of any suitable material and in any appropriate dimensions without departing from the scope of this invention. Each of the aforesaid components of the portable, two-part adhesive delivery device 1 will be discussed in detail hereinafter.

Figure 2:
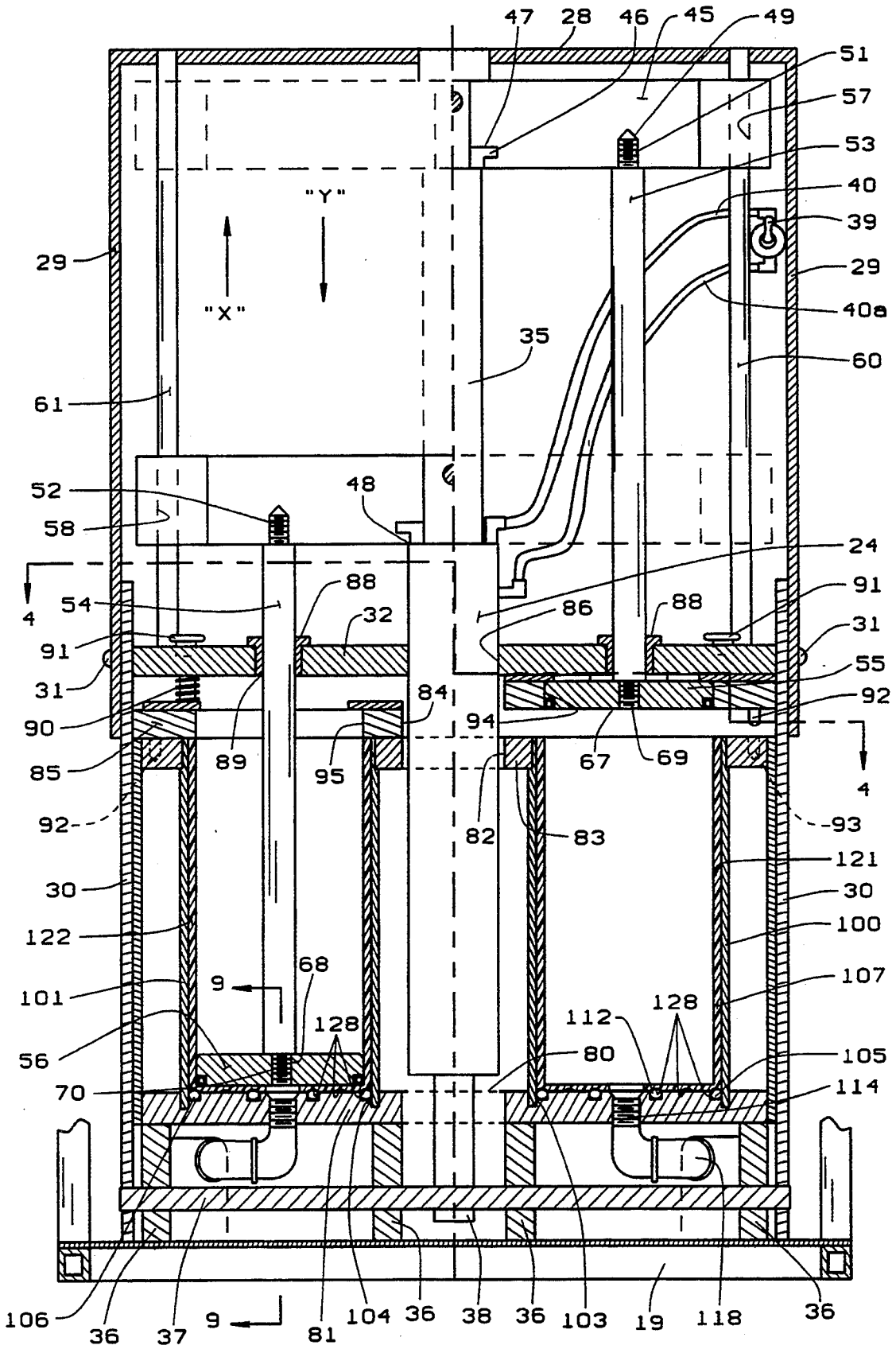
FIG. 2 is a sectional view thereof taken along line 2—2 of FIG. 1.
Figure 4:
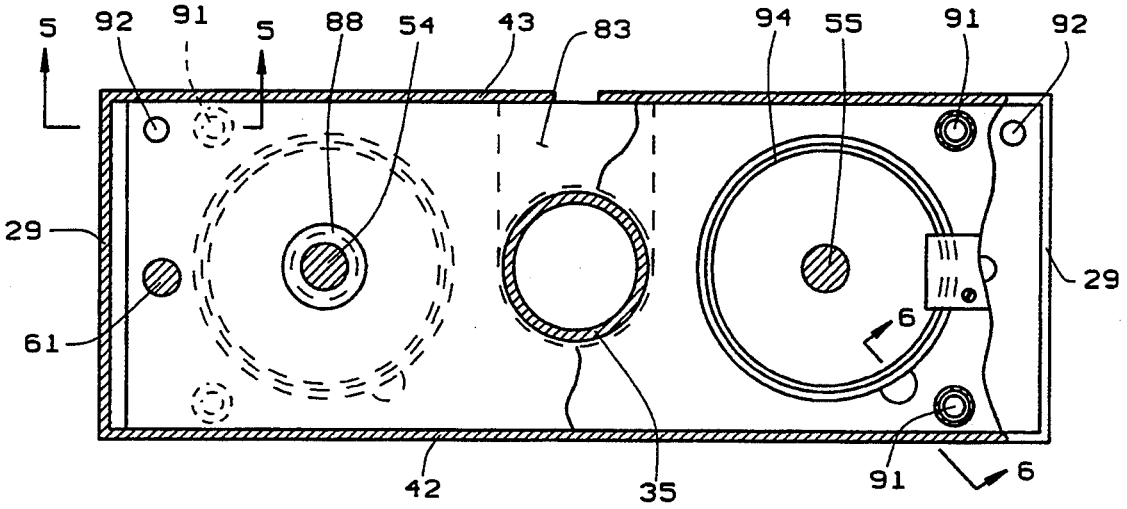
FIG. 4 is a sectional view thereof taken along line 4—4 of FIG. 2.
Figure 5:
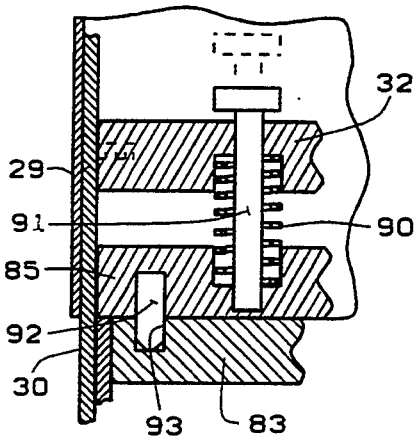
FIG. 5 is a fragmentary sectional view taken along line 5—5 of FIG. 3.

As shown in more detail in FIG. 2, the cartridge holder and dispensing assemblies 3, 4, 5 are surrounded by a housing formed by a top wall 28 and upper side walls 29 connected to lower side walls 30 by rivets 31 or other appropriate connecting means. An intermediate support wall 32 connects the opposed sets of side walls 29, 30 at approximately the area of their juncture. It should be noted that the housing may have operable front and back walls or doors 42, 43 (FIGS. 4, 9) to completely enclose the dispensing and cartridge holding assemblies 3, 4, 5 during use or transportation.

The pivotable hydraulic actuated dispensing member 5 is best illustrated in FIGS. 1–7. A centrally located hydraulic cylinder 34, having an internal hydraulic piston head (not shown) and a piston rod 35 cooperatively extending therefrom, is pivotally attached to the floor 19 by bottom support members 36 by a pivot rod 37 through a concentric cylinder support arm 38 as will be further explained. The hydraulic cylinder 34 is cooperatively attached to a hydraulic valve 39 by hydraulic lines 40 and 40*a*.

The housing lower side walls 30 are pivotably attached to the lower support members 36 by the lower pivot rod 37 so that the housing can pivot with the dispensing assembly 5.

The piston rod 35 is attached to a reciprocal header 45 by means of flanges 46 formed on the free end of the piston rod 35 engaging a cutout 47 formed in the header 45. The hydraulic cylinder 34 and the piston rod 35 are of heavy duty construction having fluid seals at 48 to prevent the leakage of hydraulic fluid where the piston rod 35 exits the cylinder 34. The flange 46 and cutout 47 are arranged to allow for some play at that joint so as to prevent excessive wear on the seals 48 due to any lateral vibration or movement of the dispensing assembly 5 during transportation or use. The attachment of the piston rod 35 to the header 45 causes the header 45 to be reciprocated in unison with the rod 35.

The header 45, formed from machined, light-weight aluminum or other appropriate material, has a pair of threaded openings 49, 50 therein to accept threaded ends 51, 52, respectively, of rods 53, 54 connected to dispensing heads or plunger cups 55 and 56. Bores 57 and 58 are formed through the header 45 and allow lateral support and guide rods 60 and 61 to extend therethrough from the top housing wall 28 to the intermediate plate 32. The purpose of the guide rods 60, 61 is to insure that the header 45 and the dispensing heads 55, 56 move in a straight path during their reciprocating up and down movement while dispensing adhesive components.

The dispensing heads or plunger cups 55, 56, with threaded openings 67 and 68 formed centrally therein are removably attached to the plunger rods 53 and 54 by threaded nipples 69 and 70 on the ends of the rods 53, 54. This design allows the cups 55, 56 to be quickly removed and replaced when they wear out or deteriorate.

Figure 6:
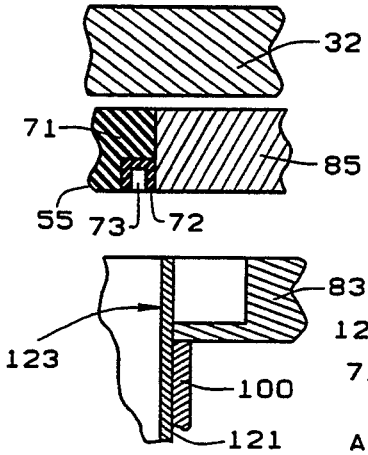
FIG. 6 is a partial, fragmentary cross-sectional view taken along line 6—6 of FIG. 4, illustrating the plunger cup.
Figure 7:
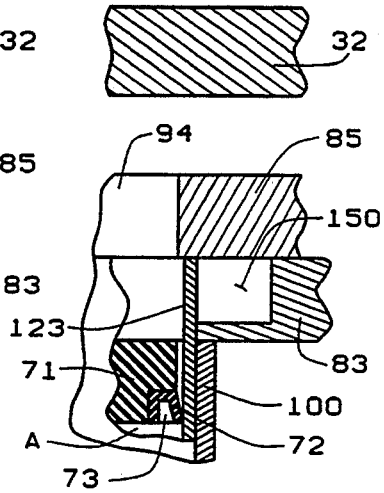
FIG. 7 is a fragmentary cross-sectional view similar to FIG. 5, but showing the plunger cup engaging the epoxy component cartridge.
Figure 8:
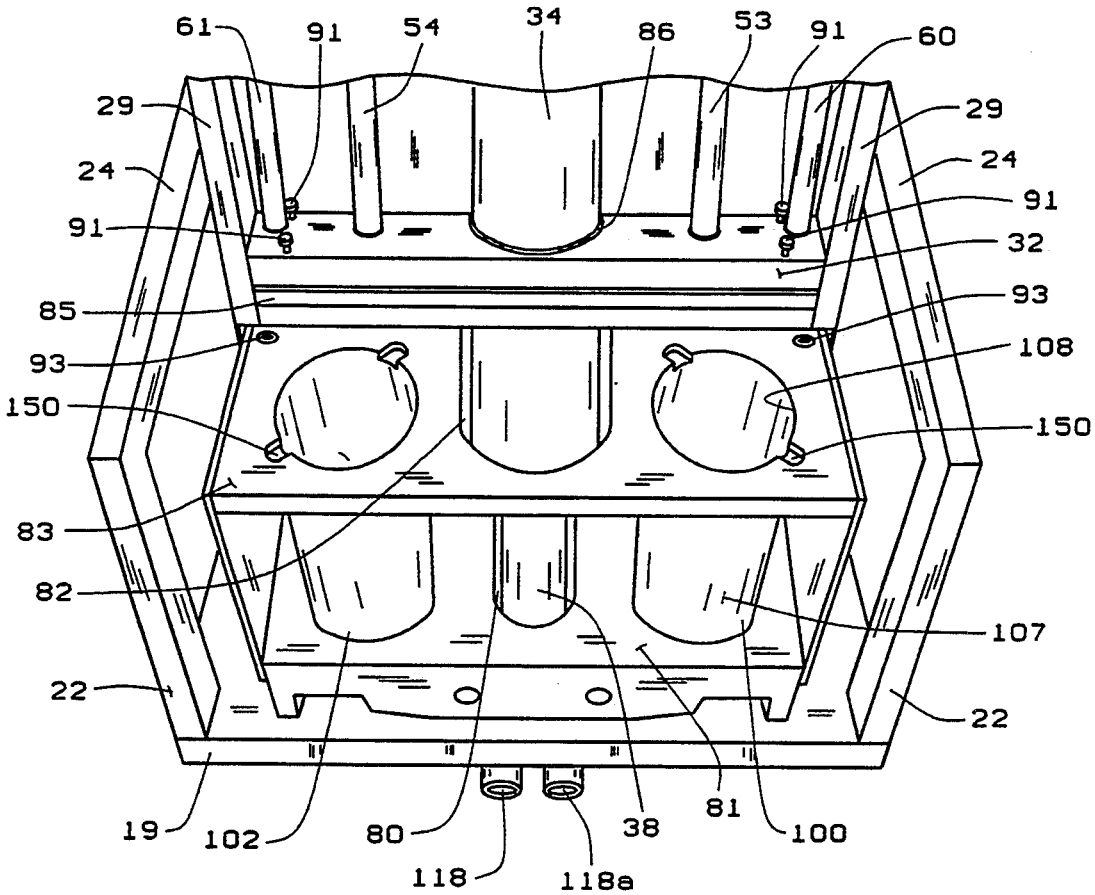
FIG. 8 is a rear elevational view illustrating the pivotable feature and cartridge access feature of the present invention.

The plunger cups 55, 56 are best illustrated in FIGS. 6 and 7 and are pre-molded of an appropriate, resilient material such as rubber or neoprene. The plunger cups 55, 56 are identical and each has a central hard disc-shaped body 71 in which the threaded openings 67 and 68 are formed, and a flexible, resilient circumferential skirt 72 enclosing a generally U-shaped, circumferential groove 73 which expands when engaging the adhesive "A" (FIG. 7). This wipes the sidewalls of the adhesive container clean and prevents adhesive from passing past the cups 55, 56. Thus as the pressure increases, so does the tightness of the seal; the higher the pressure, the better is the seal.

Figure 3:
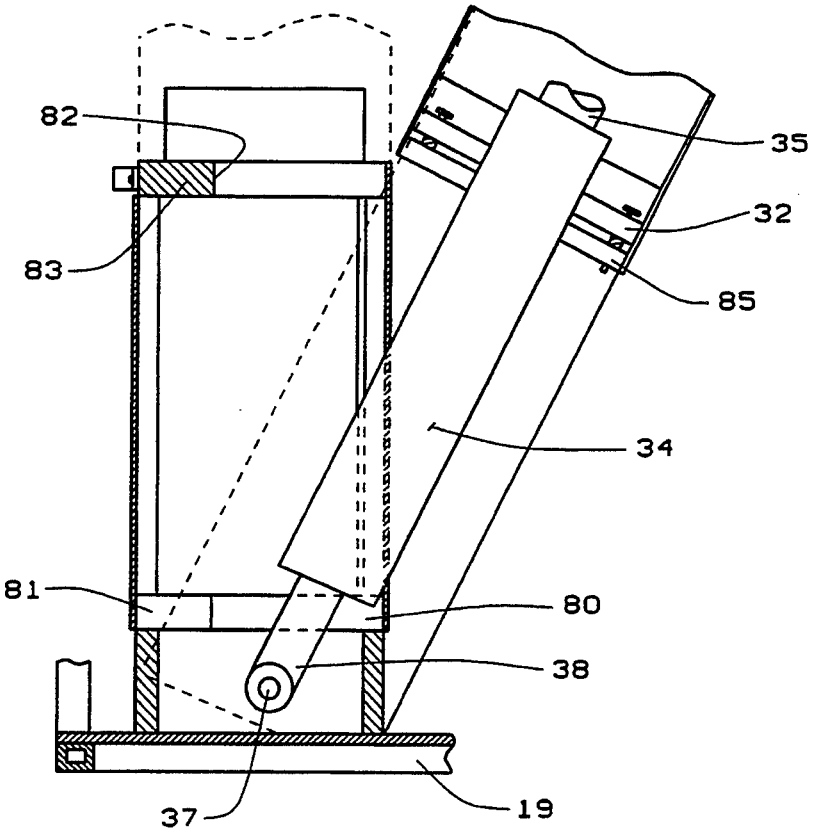
FIG. 3 is a partial side elevational view of the present invention illustrating the pivotable feature of the plunger assembly.

The unique, pivotable feature of the plunger dispensing assembly 5, are best illustrated in FIGS. 1–4 and FIG. 8. As stated hereinbefore, the hydraulic cylinder 34 is pivotably attached through the concentric cylinder support arm 38 to the bottom supports 36 by the pivot rod 37. The concentric cylinder support arm 38 extends upward through an elongated slot 80 formed in a cartridge holder support platform 81 (FIG. 3). The cylinder 34 extends upwardly through an open-ended slot 82 formed in a fixed lower plate 83, through an opening 84 formed in a floating middle plate 85 and through an opening 86 formed in the intermediate support wall 32. The intermediate support wall 32 and the lower plate 83 are attached to the lower housing wall 30. The middle plate 85 is designed to float with the movement of the plunger cups 55 and 56 as will be described hereinafter.

The plungers 53 and 54 extend downward through bushings 88 which line openings 89 formed in the wall 32. Four bias springs, as at 90, are situated between the wall 32 and the floating middle plate 85 at the four corners of the plates 32, 85 and are secured into position by four vertically movable positioning pins 91. A pair of fixed positioning pins 92 extend down from the rear lower surface of the floating plate 85 and are positioned above complimentary pin seats 93 formed in the fixed lower plate 83. The floating middle plate 85 has plunger cup seat recesses 94 and 95 formed therein.

The cartridge holder assembly 4 and the pre-filled cartridges of the present invention are best illustrated in FIGS. 2 and 9–12. The cartridge holder assembly 4 comprises a first cylindrical cartridge holder 100 and a cylindrical second cartridge holder 101 mounted on the cartridge support platform 81 in circular grooves 103 and 104, respectively, having "O"-ring seals 105 and 106 associated therewith. The cartridge holders 100, 101 are generally cylindrical in shape and are machined from high strength, light-weight aluminum or other appropriate material. The cartridge holders 100, 101 are mounted directly below the plunger cups 55 and 56 respectively. The cartridge holder 100 has a cylindrical outer wall 107, which defines a top opening 108, and overflow holes 110 through the platform 81. An outflow orifice 111 also extends through the platform 81 and is sealed by an "O"-ring 112. A seal-piercing die 113 is centrally positioned in the platform 81 and aligned with the outflow orifice 111. The second cartridge holder 101 is identical.

Figure 9:
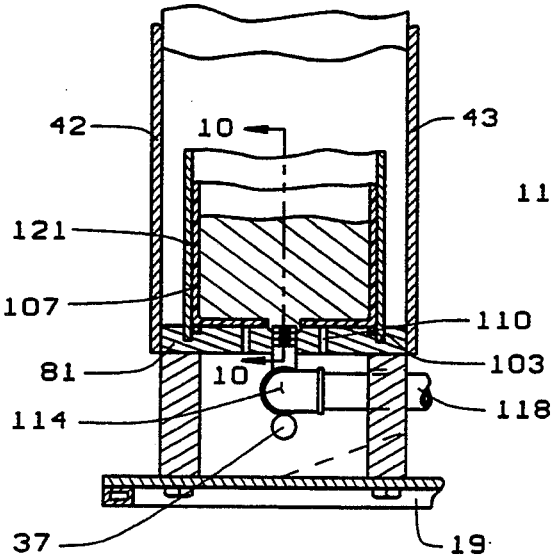
FIG. 9 is a fragmentary sectional view taken along line 9—9 of FIG. 2.
Figure 10:
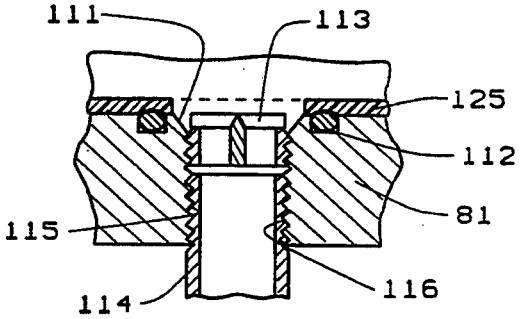
FIG. 10 is a fragmentary sectional view taken along line 10—10 of FIG. 2.
Figure 11:
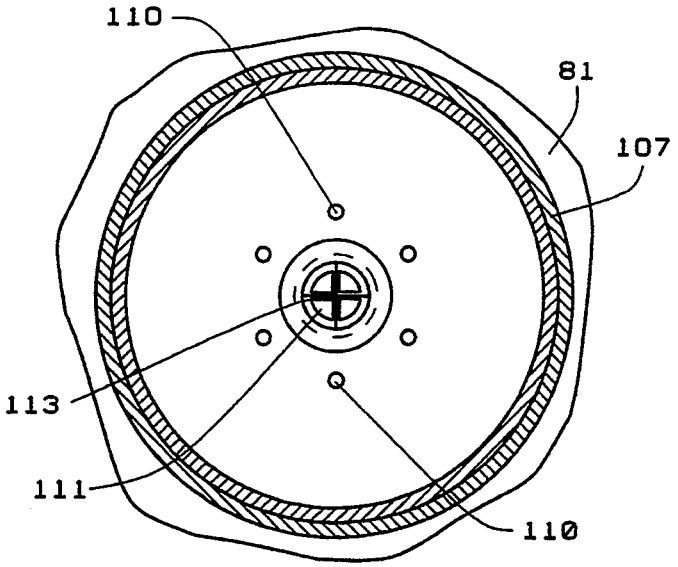
FIG. 11 is a fragmentary top plan view of one of the cylindrical cartridge holders of the present invention.

FIGS. 9–11 best illustrate the construction of the bottom of the cartridge holders 100, 101. As noted, the construction of the second cartridge holder 101 is identical to the cartridge holder 100. The outflow orifice 111, sealed with the "O"-ring 112, leads to an outflow hose coupling 114 which has a threaded portion 115 which terminates in the seal-piercing die 113. The die 113 and threaded portion 115 engage the threads 116 which line the outflow-orifice 111 formed in the support plate 81. The coupling 114 in turn cooperates with the dispensing hoses 118, 118*a* (shown at 13, 13*a* in FIGS. 1 and 13).

Figure 12:
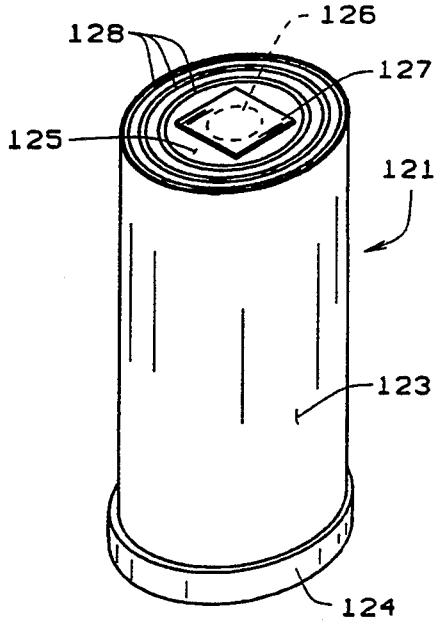
FIG. 12 is a perspective view of a pre-loaded adhesive component cartridge of the present invention.

Identical pre-filled cartridges 121, 122 are designed to slide into the open ends 108 of the cartridge holders 100 and 101. The cartridge 121, as shown inverted in FIG. 12, is constructed from high impact plastic or other appropriate material preferably having a volume of approximately 1.5 gallons, and has a generally cylindrical outer wall 123 with an upper circumferential grasping flange 124 defining a top opening (not shown). The wall 123 has a slight taper from the top opening to the bottom wall 125 of approximately 0.060 inch to facilitate bleeding of air from the holder 100 when the cartridge 121 is inserted therein. The bottom wall 125 has an outflow orifice 126 formed centrally therein which is covered by a pierceable seal 127 made of appropriate pierceable material, such as plastic film or moisture-proof paper. It should be noted that each cartridge 121, 122 is pre-filled with either the resin or catalyst component of the two-part adhesive. The open end (not shown) is covered with a plastic seal (not shown) or other appropriate cover which is removed upon insertion into a cartridge holder as will be hereinafter described.

The cartridge end 125 is provided with a series of concentric grooves 128. Two of the grooves 128 are aligned with the O-ring seals 112 and 105 which are positioned in the platform 81. Thus, when the cartridge 121 is placed in the cylinder 100, the cartridge end 125 seats against the top of the platform 81 and the O-rings 112 and 105 seat in the grooves 128. When pressure is exerted against the material in the cartridge 121 by the piston 55, the cartridge end 125 is firmly sealed against the O-rings 112 and 105 to seal the end of the cartridge and prevent leakage between the cartridge end face 125 and the top of the platform 81.

Figure 13:
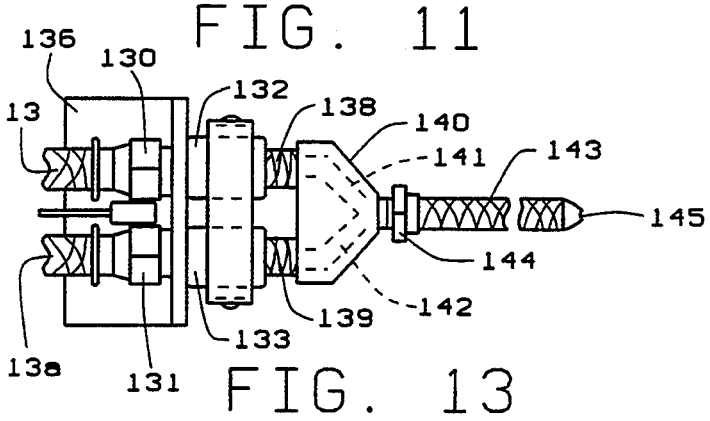
FIG. 13 is a fragmentary rear elevational view of the static mixer component of the present invention.
Figure 14:
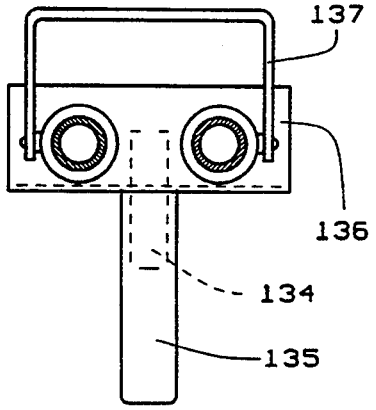
FIG. 14 is a sectional view of the static mixer taken along line 14—14 of FIG. 1.

Turning now to a detailed description of the dispensing nozzle assembly (shown at 15 in FIG. 1), and as best illustrated in FIGS. 13 and 14, the hoses 13, 13a connect the outflow orifices 111 of the respective cartridge holders 100, 101 to hose fittings 130 and 131 on ballcock valves 132 and 133. The valves 132, 133 are conventionally actuated by a trigger 134 housed in a pistol-grip 135. The assembly 15 is supported by a brace 136 having a top handle 137 pivotally attached thereto. The ballcocks 132 and 133 are operatively connected through hose pieces 138 and 139 to a conventional mixer head 140 which has inlet channels 141 and 142 formed therein which cooperate with and lead into a conventional static mixer 143 which is attached to the mixer head 140 by a fitting 144. The static mixer 143 has an outflow orifice 145 formed in the tip thereof.

In use, the gasoline engine 11 is started and activates the pump 9. The valve 39 is manipulated so that hydraulic fluid from the reservoir 7 goes through the pump 9 to the cylinder 34 to move the hydraulic piston through the cylinder 34 in an upper direction (shown by the arrow "X" in FIG. 2), thus lifting the header 45 and lifting the associated piston rods 53, 54 until the plunger cups 55 and 56 engage and recede into the plunger cup recesses or seats 94 and 95 in the floating middle plate 85. This urges the plate 85 against the bias springs 90 and thereby lifts the positioning pins 92 out of their respective seats 93 so as to allow the middle plate 85 to pivot away from the lower plate 83 with the second dispensing member 5. This exposes the cartridge holder open ends 108 and allows the concentric cylinder support arm 38 to pivot on the rod 37 while hydraulic cylinder 38 moves within elongated slot 80 and open-ended slot 82.

Pre-filled adhesive cartridges 121 and 122 are inserted, open ends up, into the cartridge holders 100 and 101 so that the pierceable seals 127 abut the seal-piercing dies 113. The housing assembly 4 and the cylinder assembly 5 are pivoted upright into locked position so that the plunger cup 55 is aligned over the open end of the pre-filled cartridge 100 and the plunger cup 56 is aligned over the open end of the pre-filled cartridge 101.

The valve 39 then is reversed, causing the hydraulic fluid to force the cylinder piston downwardly into the hydraulic cylinder 34 in the direction of the arrow "Y" in FIG. 2. The header 45 and the piston rods 53 and 54 move downwardly in unison. The plunger cups 55 and 56 also move downwardly out of the recesses 94 and 95, relieving the upward pressure on the floating plate 85 allowing plate 85 to move downwardly under pressure of bias springs 90 until the positioning pins 92 engage the seats 93 to securely position the plunger assembly 5 over the cartridges 121, 122.

Downward movement of the hydraulic piston with the header 45 and the plungers 53, 54 continues until the plunger cups 55, 56 engage the top surfaces of the adhesives contained in the pre-filled cartridges 121, 122.

In use, as illustrated in FIGS. 6 and 7, the cup 55 (with cup 56 being identical thereto), is slightly undersized relative to the circumference of the pre-filled cartridges 121. When the cup 55 enters the cartridge 121, there is a slight space between the cup 55 and the interior wall 123 of the cartridge 121 which allows air to bleed off between the wall 123 and the cup 55. As the cup 55 engages the adhesive material "A", the adhesive material "A" is forced up into U-shaped opening 73, effectively forcing the skirt 72 outwardly to form a seal between the edge of the skirt 72 and the interior wall 123 of the pre-filled cartridge 121, so that the entire cup 55 covers the entire expanse of the surface of the adhesive "A".

Downward movement of the hydraulic piston causes the header 45 and the plunger rods 53, 54 to move in unison downwardly so that the plunger cups 55, 56 force the adhesive against the pierceable seals 127 until the seals 127 are severed by the dies 113. At the same time, the cartridge ends 125 and the grooves 128 seat against the seals 112 and 105 to seal the cartridge ends 125 from the top of the platform 81. Adhesive components from the respective cartridges 121, 122 are forced out through the outflow orifices 111 out through the couplings 114, through the hoses 118 and **118*a* to the ballcock valves 132 and 133. The user opens the ballcock valves 132 and 132 conjointly by pressing the trigger 134, thus allowing the two adhesive components to flow through the valves 132, 133, through the connector hose portions 138, 139 into the inlet channels 141 and 142 in the mixer head 140, through the fitting 144 and into the static mixer 143, where the resin and the catalyst are combined. Continued downward pressure of the plunger cups 55, 56 on the adhesive forces the mixed adhesive components out of the orifice 146 formed in the tip of the static mixer 143** and onto the work surface.

When all of the adhesive is forced out of the pre-filled cartridges 121, 122, the hydraulic valve means 39 is reversed, and the plunger cups 55, 56 move upwardly into recesses 94, 95, so that the plunger assembly 5 can be pivoted away from the cartridge holder assembly 4 as previously described. This allows the empty cartridges 121, 122 to be removed by grasping the flange 124 at the finger recess 150 formed in the lower plate 83 and new cartridges inserted.

Herein, directional terms, such as, for example, "downward", "downwardly", "down", "upwardly", or "up" and terms of like import refer to the dispenser assembly 1 in a conventional orientation, in which dispenser 1 appears in FIG. 1 and other views of the drawings, but are not intended to limit the dispenser provided by the invention to any particular orientation.

Other modifications may also be made to the two-part adhesive dispenser provided by means of this invention without departing from the scope and spirit of this invention which are defined by means of the appended claims, and consequently, in accordance with such claims, the present invention may be practiced otherwise and as specifically described herein in the claims.

What is claimed:

1. A device for the delivery of a two component adhesive comprising:

a support structure;

a dispensing assembly on the support structure having a first member and a second member, one of the members having a pair of cylindrical receptacles for receiving filled cartridges containing adhesive components and the other of said members containing means for dispensing the adhesive components from the cartridges, the member containing said dispensing means being movable with respect to the member having said pair of cylindrical receptacles whereby the dispensing means are movable into and out of alignment with the receptacles so that the cartridges can be loaded and unloaded into the receptacles;

means for locking the two members in position whereby the dispensing means and the receptacles are in alignment; and means for moving the dispensing means in concert against one end of each of the filled cartridges to drive the adhesive components out of the other ends of the cartridges.

2. The device of claim 1 wherein said means for moving said dispensing means in concert against one end of each said filled cartridges further comprises a pair of hydraulic-actuated plunger assemblies.

3. The invention of claim 1 wherein said means for locking the two members in position whereby the dispensing means and receptacles are in alignment comprises a lower plate having at least one positioning pin seat formed therein and a second, floating plate having at least one complimentary positioning pin depending therefrom, said floating plate disposed so as to allow said positioning pin to engage in said seat when said dispensing means is positioned over said receptacles and said floating plate disposed so as to allow said positioning pins to disengage said pin seat when said dispensing means is to be moved away from said receptacle.

4. The invention of claim 1 including at least one O-ring positioned on the cartridge holder first end and spaced outwardly from the adhesive dispensing means.

5. The invention of claim 4 wherein the cartridges have a dispensing end with a central opening therein through which the contents are dispensed, a pierceable seal over the central opening, and a series of circular grooves spaced outwardly from the central opening and aligned with the O-rings on the cartridge holder to seal the end of the cartridge from the top surface of the cartridge holder.

6. The invention of claim 1 wherein the means for dispensing the adhesive components comprises plungers for engaging the adhesive components in the cartridges, said plungers comprising flexible edged cups which conform to their pre-molded shape when moved out of engagement with said adhesive components and spread to engage the adhesive components when moved in an adhesive component dispensing direction.

7. A device for the delivery of a two-part adhesive comprising:

a supporting structure;

first and second cartridge holders mounted on said supporting structure, each said cartridge holder having a pre-filled cartridge therein, each of said cartridge holders having a first adhesive dispensing end and an open second end for accepting said pre-filled adhesive cartridge;

a first plunger at the cartridge receiving open second end of said first cartridge holder, said first plunger having means thereon to engage the adhesive within the pre-filled cartridge;

a second plunger at the cartridge receiving open second end of said second cartridge holder, said second plunger having means thereon to engage the adhesive within the cartridge;

means connecting said first and second plungers whereby said second plunger moves in unison with said first plunger;

means for releasably securing said first and second plungers at said first and second cartridge receiving open second ends;

a hydraulic cylinder operatively connected to and arranged to move with said first and second plunger;

a fluid containing hydraulic system operatively connected to said hydraulic cylinder so as to actuate said hydraulic cylinder;

a hydraulic pump cooperatively connected in said hydraulic system;

a power source to power said hydraulic pump; and control means for selectively driving said hydraulic cylinder either in an upward or downward direction by hydraulic pressure.

8. The device of claim 7 wherein said first and second plungers and said hydraulic cylinder are pivotable to allow said plungers to be pivoted away from said cartridge receiving openings to provide access to said first and said second open ends of said cartridge holders to facilitate the placement of such pre-loaded adhesive cartridges.

9. The invention of claim 7 wherein said power source is a gasoline powered engine having a 6:1 gear reduction.

10. The invention of claim 7 wherein said supporting structure is a portable cart.

11. The invention of claim 7 wherein said supporting structure has at least one pair of opposed wheels.

12. The invention of claim 7 wherein said support structure has at least one pair of opposed handles.

13. The invention of claim 7 wherein said adhesive dispensing means at said first end of said cartridge holders further comprises a die disposed to pierce a pierceable seal on an end of such pre-loaded cartridges so as to allow an effluence of the contents thereof.

14. A device for the delivery of a two-part adhesive comprising:

a supporting structure;

first and second cartridge holders mounted on said supporting structure, each said cartridge holder having a pre-filled cartridge therein, each of said cartridge holders having a first adhesive dispensing end and an open second end for accepting said pre-filled adhesive cartridge;

a first plunger at the cartridge receiving open second end of said first cartridge holder, said first plunger having means thereon to engage the adhesive within the pre-filled cartridge;

a second plunger at the cartridge receiving open second end of said second cartridge holder, said second plunger having means thereon to engage the adhesive within the cartridge;

means connecting said first and second plungers whereby said second plunger moves in unison with said first plunger;

means for releasably securing said first and second plungers at said first and second cartridge receiving open second ends comprising an interlocking plate assembly having a lower plate having at least one positioning pin seat formed therein and a second, floating plate having at least one complimentary positioning pin depending therefrom, said floating middle plate disposed to be responsive to movement of said plungers so that said depending positioning pin engages said pin seat when said hydraulic cylinder is driven downward to secure said assembly in place and disposed to allow said depending pin to disengage said positioning seat when said cylinder is driven upward;

a hydraulic cylinder operatively connected to and arranged to move with said first and second plunger;

a fluid containing hydraulic system operatively connected to said hydraulic cylinder so as to actuate said hydraulic cylinder;

a hydraulic pump cooperatively connected in said hydraulic system;

a power source to power said hydraulic pump; and control means for selectively driving said hydraulic cylinder either in an upward or downward direction by hydraulic pressure.

15. A device for the delivery of a two-part adhesive comprising:

a supporting structure;

first and second cartridge holders mounted on said supporting structure, each said cartridge holder having a pre-filled cartridge therein, each of said cartridge holders having a first adhesive dispensing end and an open second end for accepting said pre-filled adhesive cartridge;

a first plunger at the cartridge receiving open second end of said first cartridge holder, said first plunger having means thereon to engage the adhesive within the pre-filled cartridge;

a second plunger at the cartridge receiving open second end of said second cartridge holder, said second plunger having means thereon to engage the adhesive within the cartridge;

means connecting said first and second plungers whereby said second plunger moves in unison with said first plunger;

means for releasably securing said first and second plungers at said first and second cartridge receiving open second ends;

a hydraulic cylinder operatively connected to and arranged to move with said first and second plunger;

a fluid containing hydraulic system operatively connected to said hydraulic cylinder so as to actuate said hydraulic cylinder;

a hydraulic pump cooperatively connected in said hydraulic system;

a power source to power said hydraulic pump; and control means for selectively driving said hydraulic cylinder either in an upward or downward direction by hydraulic pressure comprising a valve means within said hydraulic system to selectively divert hydraulic fluid into said hydraulic cylinder.

16. A device for the delivery of a two-part adhesive comprising:

a supporting structure;

first and second cartridge holders mounted on said supporting structure, each said cartridge holder having a pre-filled cartridge therein, each of said cartridge holders having a first adhesive dispensing end and an open second end for accepting said pre-filled adhesive cartridge;

O-rings positioned on the cartridge holder first end spaced outwardly from the said adhesive dispensing means;

a first plunger at the cartridge receiving open second end of said first cartridge holder, said first plunger having means thereon to engage the adhesive within the pre-filled cartridge;

a second plunger at the cartridge receiving open second end of said second cartridge holder, said second plunger having means thereon to engage the adhesive within the cartridge;

means connecting said first and second plungers whereby said second plunger moves in unison with said first plunger;

means for releasably securing said first and second plungers at said first and second cartridge receiving open second ends;

a hydraulic cylinder operatively connected to and arranged to move with said first and second plunger;

a fluid containing hydraulic system operatively connected to said hydraulic cylinder so as to actuate said hydraulic cylinder;

a hydraulic pump cooperatively connected in said hydraulic system;

a power source to power said hydraulic pump; and control means for selectively driving said hydraulic cylinder either in an upward or downward direction by hydraulic pressure;

the cartridges each having a dispensing end with a central opening therein through which the contents are dispensed, a pierceable seal over the central opening, and a series of circular grooves spaced outwardly from the central opening and aligned with the O-rings on the cartridge holder to seal the end of the cartridge from the top surface of the cartridge holder.

17. A device for the delivery of a two-part adhesive comprising:

a supporting structure;

first and second cartridge holders mounted on said supporting structure, each said cartridge holder having a pre-filled cartridge therein, each of said cartridge holders having a first adhesive dispensing end and an open second end for accepting said pre-filled adhesive cartridge;

a first plunger at the cartridge receiving open second end of said first cartridge holder, said first plunger having means thereon to engage the adhesive within the pre-filled cartridge;

a second plunger at the cartridge receiving open second end of said second cartridge holder, said second plunger having means thereon to engage the adhesive within the cartridge;

said adhesive engaging means on said plungers comprising flexible edged cups which conform to their pre-moldled shape when said hydraulic cylinder is driven in an upward direction and spread to engage a surface of an adhesive when said hydraulic cylinder is driven in a downward direction by hydraulic pressure.

means connecting said first and second plungers whereby said second plunger moves in unison with said first plunger;

means for releasably securing said first and second plungers at said first and second cartridge receiving open second ends;

a hydraulic cylinder operatively connected to and arranged to move with said first and second plunger;

a fluid containing hydraulic system operatively connected to said hydraulic cylinder so as to actuate said hydraulic cylinder;

a hydraulic pump cooperatively connected in said hydraulic system;

a power source to power said hydraulic pump; and control means for selectively driving said hydraulic cylinder either in an upward or downward direction by hydraulic pressure.

* * * * *